US008394303B2

(12) United States Patent
Lempfer

(10) Patent No.: US 8,394,303 B2
(45) Date of Patent: Mar. 12, 2013

(54) METHOD FOR MANUFACTURING WOOD FIBER INSULATING BOARDS

(75) Inventor: Karsten Lempfer, Toenisvorst (DE)

(73) Assignee: Siempelkamp Maschinen—und Anlagenbau GmbH & Co. KG, Krefeld (DE)

( * ) Notice: Subject to any disclaimer, the term of this patent is extended or adjusted under 35 U.S.C. 154(b) by 133 days.

(21) Appl. No.: 13/056,653

(22) PCT Filed: Aug. 14, 2009

(86) PCT No.: PCT/EP2009/005912

§ 371 (c)(1),
(2), (4) Date: May 16, 2011

(87) PCT Pub. No.: WO2010/022864

PCT Pub. Date: Mar. 4, 2010

(65) Prior Publication Data

US 2011/0291316 A1 Dec. 1, 2011

(30) Foreign Application Priority Data

Aug. 26, 2008 (DE) ..... 10 2008 039 720

(51) Int. Cl.
*B27N 3/02* (2006.01)

(52) U.S. Cl. ..... 264/122

(58) Field of Classification Search ..... None
See application file for complete search history.

(56) References Cited

U.S. PATENT DOCUMENTS

| | | | | |
|---|---|---|---|---|
| 5,302,332 | A * | 4/1994 | Simola et al. | 264/119 |
| 5,456,982 | A * | 10/1995 | Hansen et al. | 428/370 |
| 6,689,298 | B2 | 2/2004 | Yoshida | |
| 7,405,248 | B1 | 7/2008 | Troeger | |
| 2006/0143869 | A1 | 7/2006 | Polhman | |

FOREIGN PATENT DOCUMENTS

| | | | |
|---|---|---|---|
| DE | 19635410 | A | 3/1998 |
| DE | 10056829 | A | 6/2002 |
| DE | 10242770 | A | 3/2004 |

* cited by examiner

*Primary Examiner* — Mary F Theisen
(74) *Attorney, Agent, or Firm* — Andrew Wilford

(57) ABSTRACT

The invention relates to a method for manufacturing wood fiber insulating boards, wherein wood fibers are mixed with thermoplastic plastic fibers as binders and a fiber mat is produced therefrom, wherein multi-component fibers composed of at least one first and one second plastic component having different melting points are used as plastic fibers, wherein the fiber mat is heated in such a way that the second component of the plastic fiber softens and wherein the fiber mat is cooled down to produce the insulating board, characterized in that a steam/air mixture having a specified dew point flows through the fiber mat to heat the fiber mat and that multi-component plastic fibers are used as binders, the first component of which has a melting point above the dew point and the second component of which has a melting point below the dew point.

16 Claims, 1 Drawing Sheet

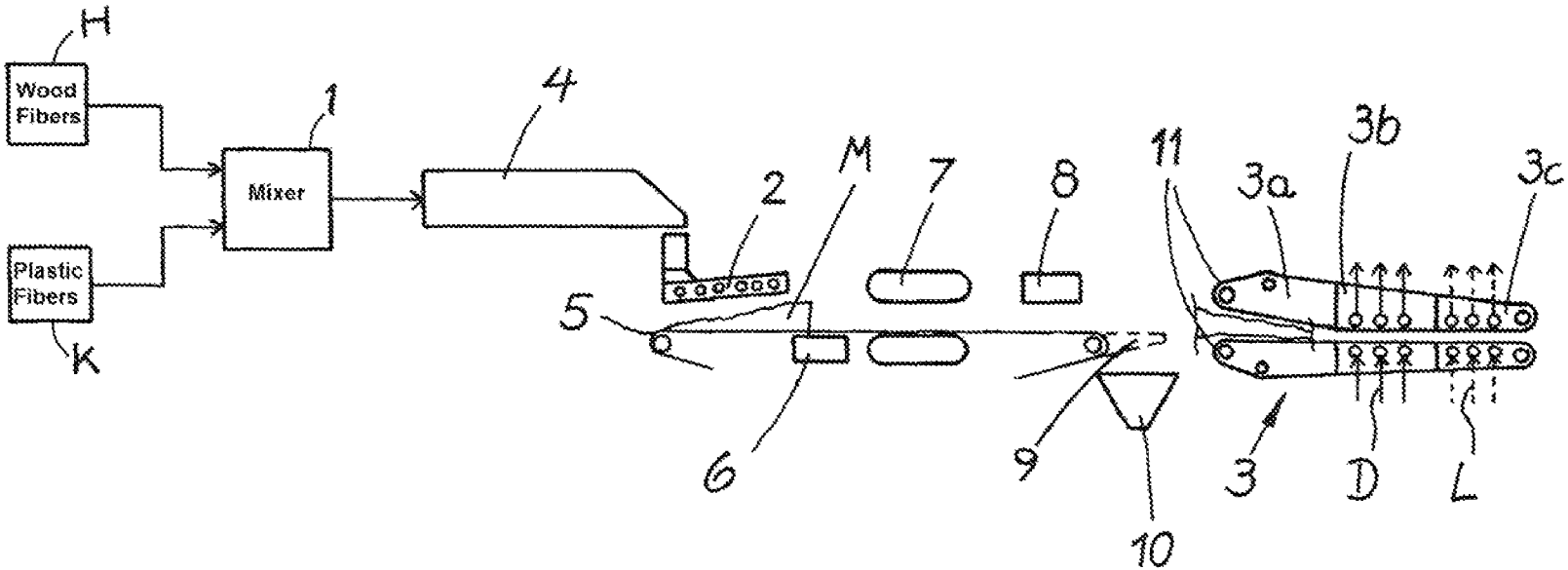
Wood Fibers
H
Plastic Fibers
K
Mixer
1
4
2
5
M
6
7
8
9
10
11
3a
3b
3c
3
D
L

METHOD FOR MANUFACTURING WOOD FIBER INSULATING BOARDS

CROSS REFERENCE TO RELATED APPLICATIONS

This application is the US national stage of PCT application PCT/EP2009/005912, filed 14 Aug. 2009, published 4 Mar. 2010 as 2010/022864, and claiming the priority of German patent application 102008039720.2 itself filed 26 Aug. 2008.

FIELD OF THE INVENTION

The invention relates to a method of making wood-fiber insulating boards where wood fibers are mixed with thermoplastic plastic fibers as binders and a fiber mat is produced therefrom, and where multicomponent fibers composed of at least one first and one second plastic component having different melting points are used as plastic fibers, and where the fiber mat is heated in such a way that the second component of the plastic fiber softens, and where the fiber mat is cooled to produce the insulating board.

BACKGROUND OF THE INVENTION

The production of boards of wooden raw material using wood fibers on the on hand and bicomponent plastic fibers on the other hand is known in the art, for example, from WO 2002/022331 [U.S. Pat. No. 7,405,248]. While conventional methods usually envision the use of thermosetting binders for making boards of a wooden material, such as for example isocyanates, the method that is disclosed in WO 2002/022331 uses bicomponent plastic fibers as a binder that are mixed with the wood fibers; for example, they are spread into a mat via a mechanical strewing head. This mat then is pressed and activated by hot air. The mat is subsequently cooled. In contrast to insulating boards manufactured with thermosetting binders, products of this type have a high level of flexibility, which is necessary, for example, for use as insulation between rafters in order to accommodate the normally encountered tolerances in building applications.

DE 100 56 829 discloses a comparable method of making an insulating board of on the one hand wood fibers and on the other hand thermoactivated plastic fibers. The fiber mixture is spread on an endless mesh belt; this fiber mixture is compacted and/or thickness-adjusted between endless mesh belts, specifically to a thickness of at least 20 mm. The plastic fibers that can be thermally activated are then cross-linked in a hot-air drying tunnel or flow-through dryer downstream to form a matrix that penetrates the wood fibers. During this step, a hot-air treatment at temperatures of approximately 150° C. occurs causing the plastic is outer layer of the bicomponent fibers, for example a polyethylene jacket, to become partially melted, while the plastic core, for example a polypropylene core, has a higher temperature resistance than the polyethylene jacket. The insulating boards that are manufactured in this way should have a volume weight of 20 kg/m$^3$ to 170 kg/m$^3$.

A further method that is known in the art for making wood-fiber insulating boards provides that wood fibers and binding fibers are combined into a fiber mat and the fiber mat is transferred to a kiln conveyor and transported from there through a heating/cooling oven where the softening of the binding fibers and thereby the internal gluing of the wood fibers, takes place. The final thickness of the wood-fiber insulating board of 3 to 350 mm is achieved by calibrating and/or compacting (see DE 10 2004 062 649 [US 2006/0143869]).

Finally, it is known in the art to use a binder belonging to the group of reactive isocyanates, in connection with the conventional production of wood-fiber insulating boards to create a fiber mat, and the mat is compacted to the desired board thickness having a raw density of 40 to 200 kg/m$^3$, preferably 60 to 80 kg/m$^3$, and the fiber mat that has been compacted in such a manner is heated with steam or a steam-air mixture. This steam-air mixture is adjusted and or regulated in terms of its moisture content and temperature in such a way that the binder completely cures while holding the compacted state, and the compacted fiber mat and/or the board-shaped final product has a compensation moisture of 12% without drying process (see DE 102 42 770). The steam-air mixture that is blown into the board provides the temperature of approximately 90° C. that is needed for the setting of the water-free binder, which is achieved by condensation of the steam part in the fiber mat. But such developments did not influence the manufacture of wood-fiber insulating boards with multicomponent plastic fibers. Moreover, DE 196 35 410 discloses a method of and an apparatus for the production of biologically degradable insulating boards comprised of wood and/or plant particles as insulating structural materials and of an environmentally safe binder. Suitable binders for this purpose are, in particular, urea or phenol resins, starches, sugar or polyvinyl acetate, and possible other binders that may be used as additional but also as sole binders are condensation-blended resins, potato pulp, latex and/or protein glues. The starting material is first chipped into a raw material and/or shredded, glued and dried either before or after application of the glue. A fleece is produced from this intermediate material by a spreading method, and in a continual throughput process this fleece is subjected to the following sequential treatment steps: first the fleece is compacted to the desired board thickness and during the following treatment steps the board is maintained at that thickness; second a steam-air mixture is introduced into the compacted fleece over a period of 10 to 20 seconds while avoiding any premature curing of the binder; third a hot-air flow is finally directed through the compacted fleece for the purpose of curing and drying.

OBJECT OF THE INVENTION

The object of the invention is to provide a method for the easy and cost-effective production of flexible wood-fiber insulating boards of high quality and at an affordable price.

SUMMARY OF THE INVENTION

According to the teaching of the invention the object of the invention is attained by a method of this class for the production of wood-fiber insulating boards where, for the purpose of heating, a steam or steam-air mixture flows through the fiber mat having a specified dew point of, for example TP=100° C., and that uses multicomponent plastic fibers as a binder whose first component has a melting point T1 above the dew point, for example >100° C., and the second component of which has a melting point T2 below the dew point, for example T2<100° C. The use of a steam-air mixture is preferred instead of pure steam. It is especially preferred if this steam-air mixture has a dew point TP=95° C., for example 85° C. to 95° C. Correspondingly, multicomponent plastic fibers are used that have a first component with a melting point T1>95° C. and a second component with a melting point T2<95° C. Water vapor is preferred in this context, for example as part of a steam/air mixture or, if necessary (pure) water vapor. The drying temperature of the steam or steam-air mixture therein can be, for example, 110 to 150° C., preferably 110° C. to 130° C.

First and foremost, the invention relies on the (known) discovery that flexible insulating boards usable, for example, as heat- and/or cold- and/or as sound-insulating boards can be produced by using multicomponent plastic fibers, for example two-component plastic fibers, as a binder. When heated, the one component partially melts or softens (for example, the outer component), while the other component (for example, the inner component) remains substantially dimensionally stable, thereby achieving, on the one hand, an internal interconnection within the board and, on the other hand, high elasticity and/or flexibility of the board due to the embedded plastic fibers as well. The plastic fibers thus have a double function in that, on the one hand, as a binder they provide the interconnection and, on the other hand, they ensure the elasticity and/or flexibility of the board. But the invention provides for the heating, and therefore the partial melting of the second component, not by way of hot air but by way of steam or a steam-air mixture that flows through the fiber mat having a dew point TP=100° C. This results in especially fast, and therefore cost-effective, heating of the fibers because the steam condenses at a defined dew point on the cold wood and plastic fibers, thereby transferring the necessary heat for the partial melting of the second plastic component, for example the jacket of the bicomponent fibers. In contrast to conventional hot-air heating, with this condensation it is possible to achieve very quick heat input. This allows, in turn, for short heat treatment periods and therefore a continual process and a short construction length of the required heating device. This process in the manufacture of the described insulating boards is made possible by multicomponent plastic fibers that are used as binder and whose first component has a melting point T1 above the dew point of the steam-air mixture and whose second component has a melting point T2 below the dew point of the steam-air mixture. Consequently, in particular for the second component, a plastic having a comparatively low melting point or softening point of below 100° C., preferably less than 95° C. is used.

To this effect, it is possible to use multicomponent plastic fibers, for example bicomponent fibers, having a core-jacket structure where the first component constitutes the core and the second component the jacket. Alternatively or additionally, it is also possible to use multicomponent plastic fibers, for example bicomponent fibers, having a side-by-side structure.

For example, the following plastic materials can be used for the first component on the one hand and the second component on the other hand:

Polyester or polypropylene are for example suitable as first component, for example for the core. Suitable for the second component, for example for the jacket, are for example copolyester or polyamide. The scope of the invention preferably also includes the possibility of using (completely) biologically degradable plastic materials for the first and/or second components in order to utilize (completely) biologically degradable fibers. The first component can be comprised of, for example, biologically degradable polyester. The first component can also be comprised of, for example, polylactide. The second component can be comprised of, for example, polycaprolactone.

According to a further suggestion by the invention, after heating, cooling air having a temperature of below 40° C., preferably below 30° C., flows through the mat. Following the partial melting of the bicomponent fibers, they are therefore cooled only until a temperature is achieved that is safely below the temperature at which softening occurs. Moreover, it is advantageous for the fiber mat to be compacted substantially to the prescribed thickness of the finished board before being heated, preferably at comparatively is low temperatures of below 40° C. Consequently, it is advantageous for the manufactured fiber mat to be first mechanically ventilated and compacted to the desired board thickness after which a steam-air mixture at a specified temperature and defined dew point is aspirated through the mat. The steam condenses on the cold fibers, thereby transferring the heat that is required for the partial melting of the jacket. After the partial melting there occurs the described cooling, and according to a preferred further development of the invention no further compacting of the mat takes place during the heating and cooling steps.

It is especially preferred for the described treatment processes to occur in a compacting and calibrating unit that is equipped with two endless mesh belts. The fiber mat is thus heated in such a compacting and calibrating unit in which the fiber mat is guided through endless continuous mesh belts. It is advantageous if heating not only is effected by steam or a steam-air mixture in this compacting and calibrating unit but, moreover, also the compacting and/or cooling. According to an especially preferred embodiment the compacting and calibrating unit thus comprises a first compacting zone in which the fiber mat is compacted, for example to the target thickness of the finished board. Following the compacting zone where, in addition, the mat is sufficiently ventilated at low temperatures, there follows the steam zone in which the steam, or preferably the steam-air mixture, flows through the mat and heats the mat. After this heating or steam zone there follows a cooling zone in which cold air flows through the mat in order to achieve a cooling effect. Therefore, it is advantageous for the mat to be initially guided into the calibrating unit through a tapered slot-shaped opening, while it is being compacted. After the compacting zone the mat passes through the press between the mesh belts that form a substantially "parallel slot," which means that no further compaction occurs. The cooling of the mat by cold air is supported by the moisture that was taken up during condensation is once again evaporated.

Moreover, it can be advantageous for the fiber mat to be already precompacted in a (separate) prepress that is arranged upstream of the compacting and calibrating unit; the mat can then be edge trimmed, if necessary. The percentage by weight of the plastic fibers relative to the total weight of the fiber mat is according to a further suggestion 5% to 20%, preferably 5% to 15%, for example 7% to 12%. The density of the finished board according to the invention is 30 to 200 kg/m$^3$, preferably 40 to 100 kg/m$^3$.

The boards that are manufactured within the scope of the present invention are of high quality and sufficiently flexible to be suitable for use as between-rafter insulation.

BRIEF DESCRIPTION OF THE DRAWING

Below, the invention is shown in further detail in a drawing that serves solely as a demonstration of one embodiment. The single FIGURE shows a facility for making wood-fiber insulating boards with the method according to the invention.

DETAILED DESCRIPTION

Essential components of such a facility are a mixer 1 for mixing the wood fibers H and the thermoplastic plastic fibers K, a spreader 2 for the production of a fiber mat and a compacting and calibrating unit 3. In detail, the following steps are conceivable:

The starting components for the production of the wood-fiber insulating boards are, on the one hand, wood fibers from a supply H and, on the other hand, multicomponent plastic fibers from a supply K that are produced in ways known in the art and added to a mixer 1. From the mixer 1 the fiber mixture reaches a storage bin 4. From the bin 4 the fiber mix is mechanically dispersed by a spreader 2 to form a fiber mat on a conveyor belt 5. The spreader 2 can be configured in ways known in the art, such as with a strewing head, for example a roller head. Below the belt it is possible to provide a scale 6, for example a belt scale for continuously detecting the weight of the mat. To prevent dust from escaping it is possible to provide for aspiration at one or more places in the area of the spreader 2.

On the conveyor belt 5 the fiber mat is first optionally cold-ventilated and precompacted in a prepress 7. Subsequently, it is possible for the mat to be trimmed by an edger/trimmer 8. The removed material is pneumatically returned to the spreading material bin 4 and/or to the spreader 2.

The fiber mat that has been precompacted and ventilated, if necessary, is now transferred by a retractable transfer nose 9 to the compacting and calibrating device 3. At start-up of the installation it is thus possible to eject unacceptable material into a discharge hopper 10 until the desired mat weight corresponds to the predetermined value. When stopping, the residual material is also fed to the discharge hopper 10. The thrown-off material is returned pneumatically to the return material bin.

In the compacting and calibrating device 3 the insulating board is produced from the fiber mat. To this end, the fiber mat is first mechanically cold-ventilated in a first compacting zone 3*a* and mechanically compacted to the desired board strength, then calibrated. In the embodiment the target density is a maximum of approximately 70 kg/m$^3$.

Immediately following the compacting zone 3*a*, a steam-air mixture D having a preset temperature (for example of approximately 120° C.) and a defined dew point (90° C. to 95° C.) is made to flow through the fiber mat in a heating or steam zone 3*b*. It is possible to feed the steam D from one side (for example from below) and discharge the steam via the other side (for example upward), preferably by suction. In this process the steam D condenses on the cold fibers, thereby transferring the heat that is needed for partially melting the jacket of the bicomponent fibers.

The invention envisions the selection of the multicomponent plastic fibers K to depend on the used steam-air mixture, and in particular as a function of the dew point of this steam-air mixture. The melting point T1 or the point when softening of the first component of the bicomponent plastic fibers occurs is in every case above the dew point TP, while the melting point T2 or the point when softening of the second component occurs is below the dew point TP. To generate the steam-air mixture, the air is indirectly heated, for example via a steam-powered heat exchanger, after which step just as much steam is added in doses as necessary while maintaining the preselected dew point. In order to avoid that the sought small density of the mat is compacted by the air pressure, the air speed is adjusted in such a way that a predetermined superatmospheric pressure is not exceeded.

After the partial melting step, the compaction of the fiber mat must be held constant until the bicomponent fibers and/or their second component have/has cooled to the point that the temperature is safely below the point at which softening occurs. To this end, immediately after the steam zone 3*b*, the mat is cooled in a cooling zone 3*c* in the compacting and calibrating unit 3, specifically by causing cooling air L to flow through the mat. The cooling air L can also be fed, for example, from below and suctioned off from above, the cooling air L also being aspirated through the mat M. It is significant in this context that the endless continuous conveyor belts of the steam press are configured as foraminous endless belts 11. The fiber mat M is thus not further compacted either in the steam zone 3*b* or in the cooling zone 3*c*, which means the press gap is substantially held constant in the steam zone 3*b* and the cooling zone 3*c*. The cooling action in the cooling zone 3*c* is supported in this context by the fact that the moisture that was taken up during the heating step is now evaporated again by condensation.

The produced board that exits the calibrating and setting unit 3 is dimensionally stable, but with sufficient flexibility and elasticity. The continuous strip of board is then fed into a severing apparatus, for example a diagonal saw, that is used to cut off preset board lengths. Loose parts that may be encountered when starting or stopping are collected in a hopper and transported to a container. Debris pieces are mechanically removed from the line after the diagonal saw step. In addition, the boards are pre-edge-trimmed. To this end, the side strips are shredded, and the shredded material together with the saw dust is suctioned off by a ventilator. The separated and pre-edge-trimmed board sections are fed to the panel and saw apparatus via a roller conveyor. Details regarding these downstream process steps are not shown.

The manufacture of the wood fibers can occur in ways that are known in the art by shredding chopped clippings in a refiner and adding steam. It is optionally possible to add a fire protection agent and/or a hydrophobic agent (for example, a wax emulsion). The initially produced wood fibers are dried in the usual manner in a drier, preferably to residual moisture of approximately 4% to 8%.

The bicomponent fibers are cut, for example, to the desired length and delivered in bales. They are separated with a bale opener, then dosed and fed into the mixer with the wood fibers.

The invention claimed is:

1. A method of making insulating boards, the method comprising the steps of sequentially:

mixing wood fibers with thermoplastic plastic fibers, making a fiber mat from the mixed wood and plastic fibers, the plastic fibers being multicomponent fibers comprised of at least a first and a second plastic component having respective first and second melting points, the first melting point being above the second melting point, heating the fiber mat with steam or a steam-air mixture to having a predetermined dew point between the first and second melting points such that the second component of the plastic fibers softens but the first component does not soften, and cooling the fiber mat and thereby hardening the second component such that the multicomponent plastic fibers adhere together and form a binder for the wood fibers.

2. The method as claimed in claim 1 wherein the steam or the steam-air mixture has a dew point TP=100° C. and the first component has a melting point T1>100° C. and the second component has a melting point T2<100° C.

3. The method as claimed in claim 2 wherein the steam or steam-air mixture has a dew point TP=95° C. and the first component has a melting point T1>95° C. and the second component a melting point T2<95° C.

4. The method as claimed in claim 1 wherein water vapor is used as the steam.

5. The method as claimed in claim 1 wherein, after heating, cooling air at a temperature TK<40° C. is flowed through the fiber mat for the cool-down.

6. The method as claimed in claim 1 wherein, before heating, the fiber mat is compacted substantially to the target density of the finished board at a temperature of below 40° C.

7. The method as claimed in claim 6 wherein the fiber mat compacted to the target density is not further compacted at all or to no substantial degree during heating or cooling.

8. The method as claimed in claim 1 wherein the fiber mat is heated in a compacting and calibrating unit in which the fiber mat is compressed between endless continuous mesh belts.

9. The method as claimed in claim 8 wherein the fiber mat is heated in a steam zone of the compacting and calibrating unit, and this zone is followed by a cooling zone in which the mat is cooled.

10. The method as claimed in claim 8 wherein the fiber mat is compacted in a compacting and calibrating zone upstream of the steam zone to the target thickness of the finished board.

11. The method as claimed in claim 8 wherein the fiber mat is precompacted and subsequently edge trimmed in a prepress upstream of the compacting and calibrating unit.

12. The method as claimed in claim 1 wherein the weight fraction of the plastic fibers relative to the total weight of the fiber mat is 5% to 20%.

13. The method as claimed in claim 1 wherein the density of the finished board is 30 to 200 kg/m$^3$.

14. The method as claimed in claim 1 the plastic fibers are bicomponent fibers having a core-jacket structure, and the first component constitutes the core and the second component the jacket.

15. The method as claimed in claim 1 wherein the plastic fibers are bicomponent fibers having a side-by-side structure.

16. The method as claimed in claim 1 wherein the wood fibers have a moisture of 5% to 15%.

* * * * *